US007938746B2

(12) United States Patent
Chipperfield

(10) Patent No.: US 7,938,746 B2
(45) Date of Patent: May 10, 2011

(54) BASKETBALL TRAINING SYSTEMS AND METHODS

(76) Inventor: Richard F. Chipperfield, Charlestown, RI (US)

( * ) Notice: Subject to any disclaimer, the term of this patent is extended or adjusted under 35 U.S.C. 154(b) by 0 days.

(21) Appl. No.: 10/583,531

(22) PCT Filed: Dec. 18, 2004

(86) PCT No.: PCT/US2004/042866

§ 371 (c)(1),
(2), (4) Date: Jun. 16, 2008

(87) PCT Pub. No.: WO2005/062841

PCT Pub. Date: Jul. 14, 2005

(65) Prior Publication Data

US 2008/0261726 A1 Oct. 23, 2008

Related U.S. Application Data

(60) Provisional application No. 60/530,946, filed on Dec. 19, 2003.

(51) Int. Cl.
*A63B 69/00* (2006.01)

(52) U.S. Cl. ..... 473/434; 473/485

(58) Field of Classification Search ..... 473/434, 473/431, 422, 447, 433, 485; 273/368
See application file for complete search history.

(56) References Cited

U.S. PATENT DOCUMENTS

| | | | | | |
|---|---|---|---|---|---|
| 611,504 | A | * | 9/1898 | Perky | 273/400 |
| 1,211,379 | A | * | 1/1917 | Maisch | 273/368 |
| 1,904,836 | A | | 4/1933 | Peoples | |
| D110,225 | S | | 6/1938 | Schutt | |
| 2,130,820 | A | * | 9/1938 | Trumbull | 473/470 |
| 2,278,616 | A | * | 4/1942 | Kettering | 473/485 |
| 2,545,615 | A | * | 3/1951 | Hatley | 473/476 |
| 3,588,103 | A | * | 6/1971 | Fuller | 473/470 |
| 4,266,763 | A | * | 5/1981 | Collins | 273/359 |
| 4,579,340 | A | | 4/1986 | Jenkins et al. | |
| 5,171,009 | A | * | 12/1992 | Filewich et al. | 473/433 |
| 5,308,059 | A | | 5/1994 | Owen, Jr. et al. | |
| 5,540,428 | A | * | 7/1996 | Joseph | 473/433 |
| 5,836,837 | A | * | 11/1998 | Craig | 473/472 |
| 6,241,628 | B1 | | 6/2001 | Jenkins et al. | |
| 6,692,385 | B2 | * | 2/2004 | Walker et al. | 473/447 |

OTHER PUBLICATIONS

EZ Shot, Inc., http://ezshotbasketball.net, © 2007, 10 printed pages.

* cited by examiner

*Primary Examiner* — Gene Kim
*Assistant Examiner* — Mike Chambers
(74) *Attorney, Agent, or Firm* — Tejpal S. Hansra

(57) ABSTRACT

Basketball training systems and methods are disclosed herein. In one embodiment, a basketball training apparatus includes a first rim and a second rim. The first rim has a center and the second rim has a center. The first rim rotates about its center and the second rim revolves about the center of the first rim.

18 Claims, 8 Drawing Sheets

BASKETBALL TRAINING SYSTEMS AND METHODS

This application is the National Stage of International Application No. PCT/US2004/042866, filed Dec. 18, 2004, which claims the benefit of U.S. Provisional Application No. 60/530,946, filed Dec. 19, 2003.

FIELD OF THE INVENTION

The present invention relates generally to athletic training systems and methods. More particularly, the present invention relates to basketball training systems and methods.

BACKGROUND OF THE INVENTION

In order to become proficient shooters, serious basketball players take hundreds or even thousands of shots per day. In a common scenario, one player shoots a number of shots, while one or more other players (or ball shaggers) retrieve made or missed shots, and pass balls back to the player that is shooting. In addition to the task of retrieving balls being exhausting (and, in some cases boring, as compared to shooting), the player (or players) retrieving basketballs must wait his (their) turn to receive an opportunity to shoot, which is an inefficient use of his (their) time.

Furthermore, due to a variety of time-constraints, the number of shots that a player may be able to take may be quite limited. For example, during the off-season (i.e., the summer months in North America), professional basketball players may shoot one thousand shots per day in an effort to improve their shot. Using ball shaggers, it may take a professional basketball player about three hours to shoot one thousand shots. During the regular season, when players are traveling and when players often are sharing a basket with their teammates, professional basketball players have rare opportunities to shoot one thousand shots in a day using a ball shagger.

It is also important for coaches to understand the shooting strengths and shooting weaknesses of each of their players. Because professional basketball coaches are unable to be present at each of their players' shooting sessions and because viewing a limited number of shots does not provide a sufficient sample-size to make a proper assessment, coaches often do not understand the shooting strengths and weaknesses of their players. Even if coaches could attend their players' shooting sessions, it is extremely tedious to record, by hand, the location of each shot and whether it was made or missed. It is also somewhat tedious to have to compute a player's shooting percentage at each location. In view of the above, coaches cannot easily design shooting drills that are tailored for each of their players to help their players improve their shooting ability.

The aforementioned problems are exacerbated at the college level where coaches are limited to approximately nineteen hours of supervised coaching time according to NCAA regulations. During the off-season, with little exception, college coaches are unable to practice with their teams at all. Furthermore, in contrast to the professional level, coaching resources are more limited and players generally have more shooting weaknesses. In addition, due to the demands associated with their schooling, it is important that college basketball players make efficient use of their time in developing their shooting proficiency.

Recreational basketball players, as well as relatively younger basketball players, may have an even more difficult time determining their shooting strengths and weaknesses because, among other things, they are sharing resources with many other individuals. In many areas, gymnasiums are overcrowded and, therefore, it is extremely difficult to shoot a large number of shots at a variety of locations on a basketball court. Additionally, because players' shots may interfere with one another (e.g., due to two or more players' shots arriving at the rim at the same time), it is difficult to properly record the results to determine shooting proficiency at such locations.

In view of the above, it would be desirable to develop a system and/or method which allows multiple players to shoot a basketball at a basket and which automatically retrieves and passes basketballs to multiple players shooting at the basket, thereby making efficient use of the basketball players' time. Furthermore, it would be desirable to develop a system and/or method which also allows players to shoot at the basket at various angles and distances, while the players maintain a somewhat fixed position relative to the floor (or ground). Even further, it would be desirable to develop a system and/or method such that the various angles and distances simulate nearly all meaningful shooting locations (other than lay-ups, for example) on a basketball court. Yet further, it would be desirable a system and/or method which assesses a player's shooting strengths and weaknesses at nearly all meaningful shooting locations (except lay-ups). Yet even further, it would be desirable to develop a system and/or method which reduces the likelihood of two or more players' shots interfering with one another due to balls reaching the rim at the same time.

In addition, in game situations, when basketball players are under pressure, they often shoot "short" shots. That is, due to nervousness or defensive pressure, a shooter may become tense and, therefore, not exert sufficient energy on the basketball to permit it to pass through the rim. Rarely do players shoot "long" shots when they are under pressure. Accordingly, it would be desirable to develop a system and/or method which will train basketball players (e.g., by muscle memory) to shoot shots that are capable of passing through the rim, whether or not they are under pressure.

SUMMARY OF THE INVENTION

The present invention is designed to meet at least one or more of the aforementioned needs. The invention is directed to basketball training systems and methods.

In one embodiment, a system and/or method is provided which allows multiple players to shoot a basketball at a basket and which automatically retrieves and passes basketballs to multiple players shooting at the basket. In another embodiment, a system and/or method is provided which also allows players to shoot at the basket at various angles and distances, while the players maintain a somewhat fixed position relative to the floor (or ground). In yet another embodiment, a system and/or method is provided such that the various angles and distances simulate nearly all meaningful shooting locations (other than lay-ups, for example) on a basketball court. In a further embodiment, a system and/or method is provided which assesses a player's shooting strengths and weaknesses at nearly all meaningful shooting locations (except lay-ups) on a basketball court. In yet a further embodiment, a system and/or method is provided which reduces the likelihood of two or more players' shots interfering with one another due to balls reaching the rim at the same time. In yet another embodiment, a system and/or method is provided which trains basketball players (e.g., by muscle memory) to shoot shots toward the back half of the rim, so that shots can be made whether or not the basketball players are under pressure.

Other embodiments, objects, features and advantages of the invention will be apparent from the following specification taken in conjunction with the following drawings.

DETAILED DESCRIPTION OF THE PREFERRED EMBODIMENT

Figure 1:
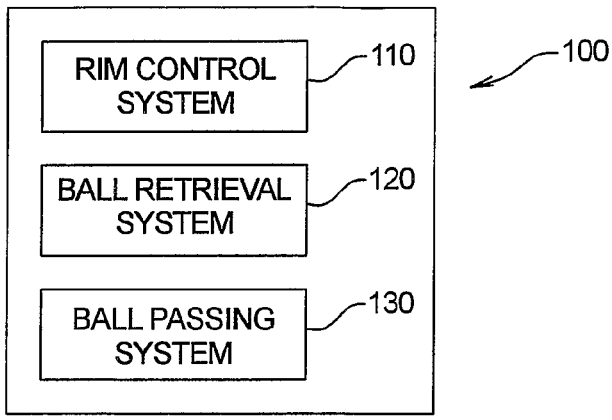
FIG. 1 is a simplified block diagram of a basketball training system in accordance with one embodiment of the present invention.

While this invention is susceptible of embodiments in many different forms, there are shown in the drawings and will herein be described in detail, preferred embodiments of the invention with the understanding that the present disclosure is to be considered as an exemplification of the principles of the invention and is not intended to limit the broad aspects of the invention to the embodiments illustrated.

FIG. 1 is a simplified block diagram of a basketball training system 100 according to one embodiment of the present invention. The basketball training system 100 includes a rim control system 110, a ball retrieval system 120 and a ball passing system 130.

As will be understood by the description provided below, each of the rim control system 110, ball retrieval system 120 and the ball passing system 130 may be used independently of one another and may be embodied in a variety of different forms. Accordingly, the rim control system 110, ball retrieval system 120 and the ball passing system 130 may each contain features that are independently patentable or that are patentable in various combinations.

Figure 2:
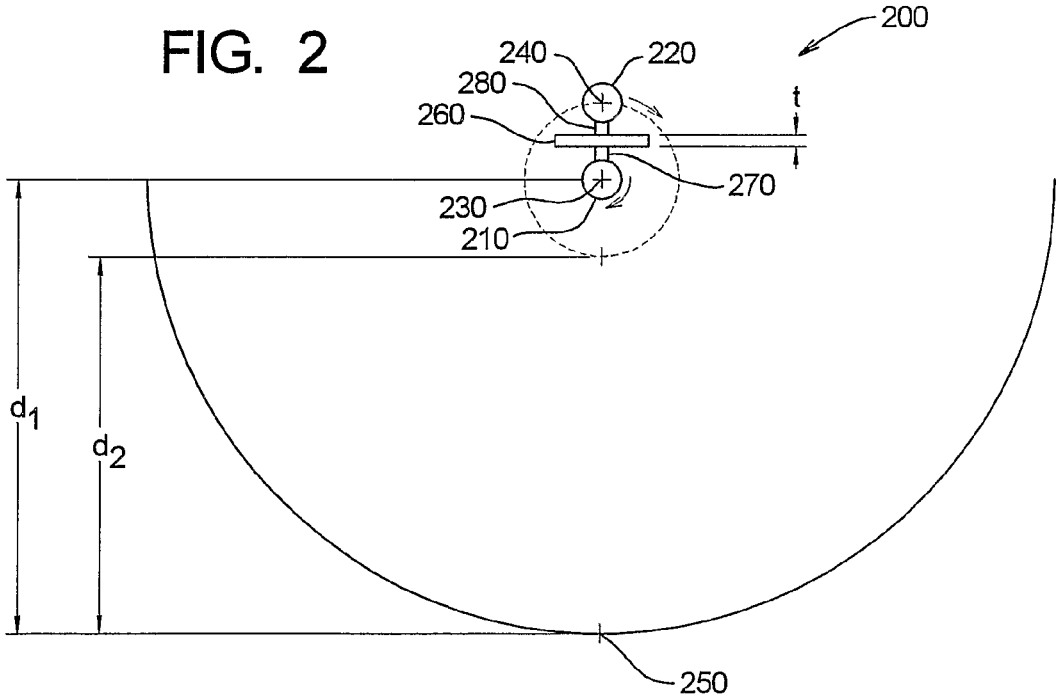
FIG. 2 is a simplified diagrammatic representation of a top view of a dual-rim system that may be used in accordance with one embodiment of the present invention.

FIG. 2 is a simplified diagrammatic representation of a top view of a dual-rim system 200 that may be controlled, for example, by the rim control system 110 of FIG. 1. The dual-rim system 200 includes a first rim 210 and a second rim 220. The first rim 210 has a center 230 and the second rim 220 has a center 240.

Importantly, the first rim 210 rotates about its center 230, while the center of the second rim 240 revolves (i.e., orbits) about the center of the first rim 230 as shown by the dashed lines in FIG. 2. Accordingly, from a single location 250 that is located at fixed distance $d_1$ from the center of the first rim 230, a player is able to simulate shots from a variety of positions on a basketball court at a first distance $d_1$ because backboard 260 is presented at a variety of angles to the player. By providing a second rim 220, a player is advantageously also able to simulate shots from a variety of other positions on a basketball court, while still being positioned at location 250. For example, when the second rim 220 has revolved about the center of first rim 210 to a position that is 180 degrees from the position shown in FIG. 2, a player positioned at location 250 will shoot shots at a second distance $d_2$. It should also be noted, however, that a player positioned at location 250 will shoot shots at a variety of other distances when shooting at the second rim 220 as its center 240 revolves about center 230 of first rim 210.

U.S. Pat. No. 5,171,009 (which names the present inventor as an inventor) describes a basketball apparatus that includes a rim that rotates about its center, so that a player is able to simulate shots from a variety of positions on a basketball court. However, from a fixed location from the center of the rim, a player is only able to simulate shots from a variety of positions on a basketball court at a single distance. U.S. Pat. No. 5,171,009 is incorporated herein by reference.

The difference in distance between first distance $d_1$ and the second distance $d_2$ depends on a variety of factors including, for example, the thickness t of the backboard 260, the length of flange 270 of the first rim, the length of flange 280 of the second rim, the diameter of the first rim 210, the diameter of the second rim 220, the thickness of the first rim 210 and the thickness of the second rim 220. Assuming the backboard has a thickness of about three inches, the length of the first flange 270 and the length of the second flange 280 are both five inches (as with standard men's basketball hoops in the U.S.), the diameter of the first rim 210 and diameter of the second rim 220 are both eighteen inches (also standard for men's basketball hoops in the U.S.), and the thickness of the first rim 210 and the thickness of the center of the second rim are both one inch (also standard), the difference in distance between first distance $d_1$ and second distance $d_2$ would be approximately thirty-three inches. Of course, the dual-rim system 200 could be designed for different distance differences. Methods of calculating other distances (e.g., at other positions of the second rim 220 as its center 240 revolves about the center 230 of the first rim 210) and distance differences will be understood by those skilled in the art.

Figure 3:
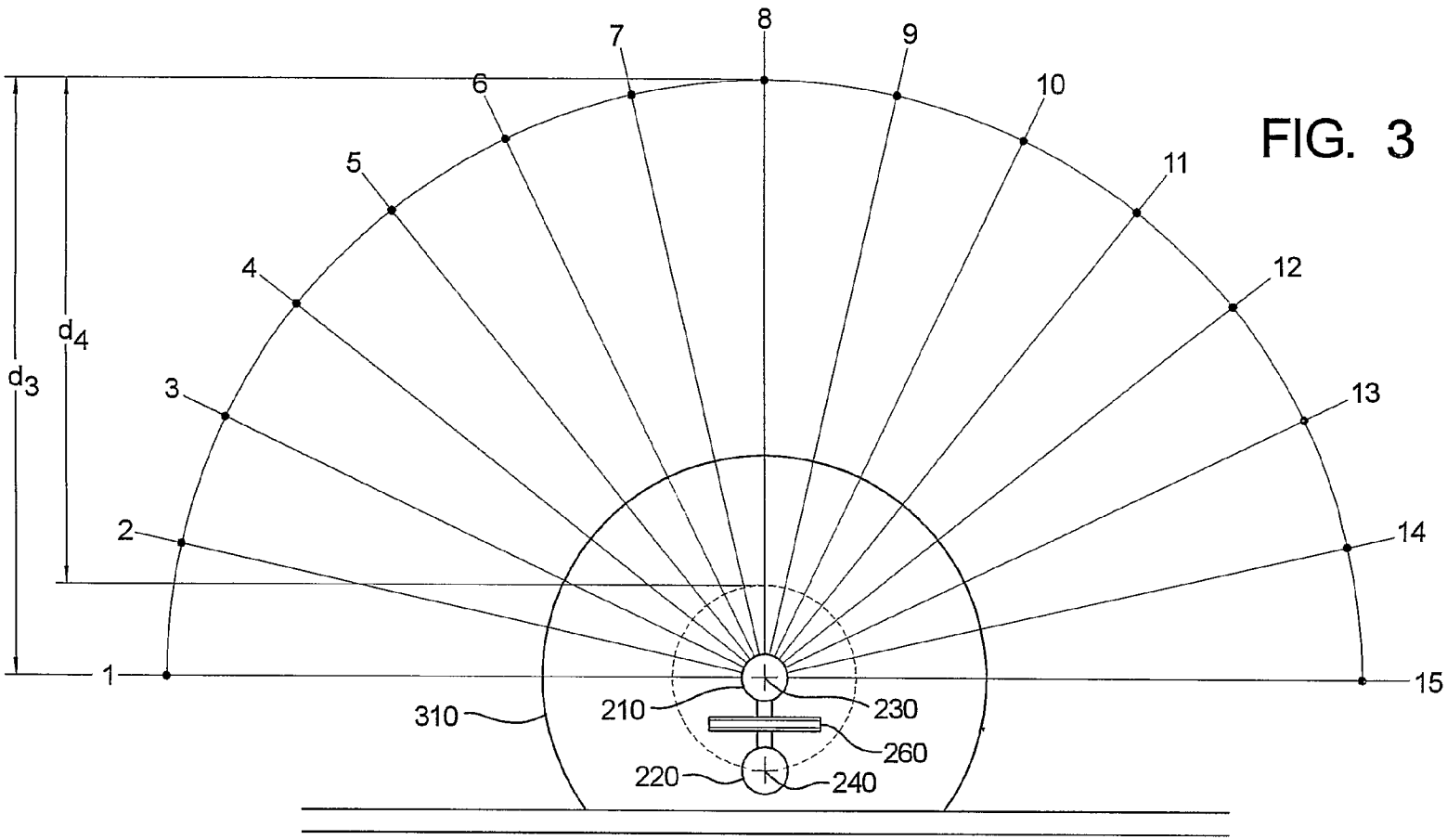
FIG. 3 is a simplified diagrammatic representation of a top view of a dual-rim system with a ball-catching net that may be used in accordance with one embodiment of the present invention.
Figure 4:
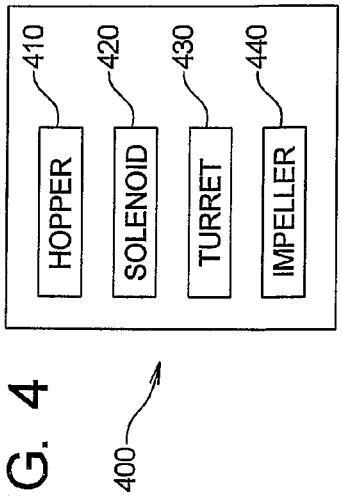
FIG. 4 is a simplified block diagram of a ball-passing apparatus that may be used in accordance with one embodiment of the present invention.

FIGS. 3 and 4 illustrate portions of one embodiment of a basketball training system that can exploit the advantages of the dual-rim system 200. Specifically, FIG. 3 illustrates a first rim 210 having a center 230 and a second rim 220 having a center 240. Like the dual-rim system of FIG. 2, the first rim 210 rotates about its center 230, while the center of the second rim 240 revolves about the center of the first rim 230. Unlike FIG. 2, however, the basketball training system of FIGS. 3 and 4 includes a ball-catching net 310 and a ball-passing apparatus 400 (see FIG. 4).

As shown in FIGS. 3 and 4, the ball-passing apparatus 400 is designed to pass basketballs to a plurality of players located at positions that are each at a first distance $d_3$ from the center of rim 230. For example, FIG. 3 shows fifteen player positions that are located a first distance d3 from the center of rim 230.

When players are shooting at first rim 210, they are shooting shots at a first distance $d_3$. As the center of the second rim 240 revolves about the center of the first rim 230, players are presented with the second rim 220 and, therefore, shoot shots at a variety of other distances. For example, when the center 240 of the second rim 220 has revolved about the center 230 of the first rim 210 such that a player positioned at position 8 is shooting perpendicularly to backboard 260, such player will be shooting at a second distance $d_4$. Accordingly, without changing positions, a plurality of players can shoot shots at a variety of angles relative to the backboard from many different distances.

With reference to FIG. 4, in one embodiment, the ball-passing apparatus 400 includes a hopper 410, a solenoid 420, a turret 430 and an impeller 440. The hopper 410 receives balls captured by ball-catching net 310. The turret 430 turns to facilitate passing of balls to players at one of a plurality of shooting stations (e.g., shooting stations 1-15). It should be noted that, in at least one embodiment, the turret 430 can turn in either direction. The solenoid 420 restricts delivery of basketballs to the impeller 440 (which rotates with the turret 430) until the turret 430 has turned to the proper location. Once the turret 430 has rotated to the proper position, the solenoid 420 releases the ball to the impeller 440, which passes a basketball to one of the players (e.g., to a basketball player located at one of stations 1-15).

Once a ball is passed by the ball-passing apparatus 400, a next ball is held by the solenoid 420 until the turret 430 has rotated to a position associated with the next player. Then, the solenoid 420 releases the next ball to the impeller 440, which passes the next basketball to the next player.

In one embodiment, passes are made by the impeller 430 approximately every 0.2 seconds and each player receives a pass approximately every 3.6 seconds. Accordingly, in only one hour, a plurality of players (e.g., 15 players) can each shoot about 1000 shots (that is, a total of 15,000 shots are taken in an hour).

Figure 5:
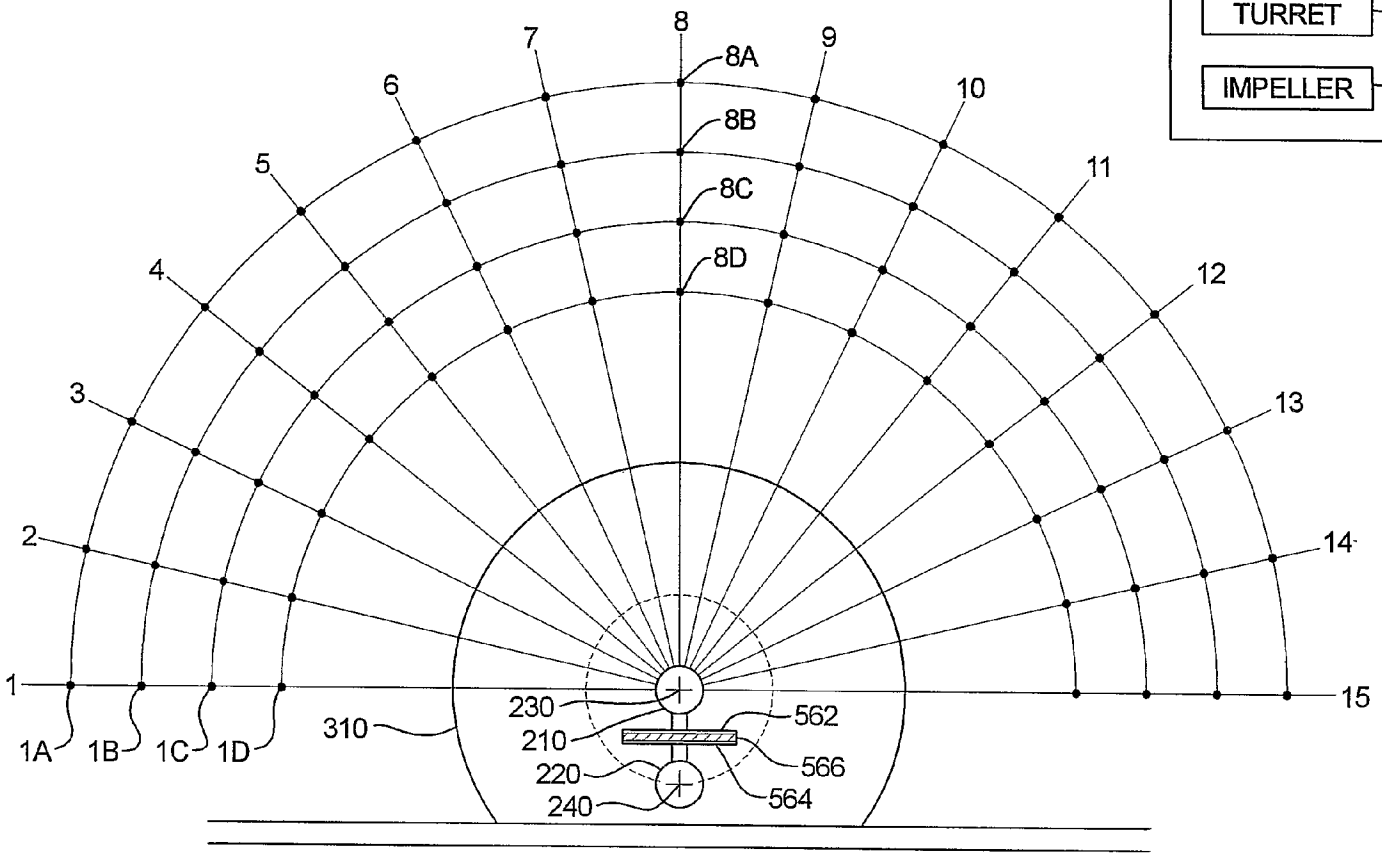
FIG. 5 is a simplified diagrammatic representation of a top view of a dual-rim system (similar to FIG. 3) that may be used in accordance with one embodiment of the present invention.

Instead of passing balls to shooting stations located at a single fixed distance from the center of the first rim 230, the ball-passing apparatus can pass balls to shooting stations located at a plurality of fixed distances from the center of the rim 230, as shown in FIG. 5. Specifically, Player 1 may have passes thrown to him at position 1A, 1B, 1C or 1D, for example, based upon a predetermined (or even a random) shooting sequence. From each of these positions 1A-1D, Player 1 will shoot at different distances, depending upon whether the player is shooting at the first rim 210 or the second rim 220 (and the amount of rotation of the second rim 220). Therefore, according to the embodiment depicted in FIG. 5, a player will be able to simulate shots at nearly all meaningful locations on a basketball court, while only moving back and forth along a radial line that passes through the center of the front rim.

It should be understood that the ball-passing apparatus 400 can take on many forms. Furthermore, the types of passes delivered to each shooter may vary based upon the shooter's skill level.

In one embodiment, for example, bounce passes are delivered at 40 mph to a location near an individual's mid-section. Delivering passes at such a high rate of speed can increase a player's dexterity. Furthermore, because a player would not want to be struck in the mid-section, a player's concentration level will be high when catching passes. Passes other than bounce passes, and speeds greater than or less than 40 mph, may be used. It should also be noted that passing speeds may be changed by providing a brake (rheostat) on a motor associated with the impeller 440.

The interval at which passes are delivered to a shooter may also be increased or decreased, as desired. For example, the passing interval may be increased to an aerobic rate, so that a pass is delivered to a shooter approximately every two seconds. In such circumstances, a player will shoot approximately 1800 shots in one hour.

With reference again to FIGS. 3 and 5, details regarding some embodiments of the ball-catching net 310 will now be discussed. In one embodiment, so that balls are properly be-netted, the ball-catching net 310 is located at a distance of about nine feet from the center of the first rim 230 and has a height of approximately twelve feet (12') relative to the floor. Furthermore, using a net that has a height of approximately twelve feet will help players to develop a high arcing shooting style, which is believed to be advantageous in many circumstances.

In one embodiment, the netting of the ball-catching net is made of Spectra, which is sold by Ashaway Line and Twine of Hopkintown, Rohde Island. In addition, to being virtually invisible, Spectra is a very strong material. For example, it has a tensile strength that is twice that of steel. Furthermore, it is not subject to stretching at as great a rate as Nylon, which prevents pouches from being formed in the netting. Even further, it is extremely lightweight.

In one embodiment, in order to reduce the likelihood that shooters are distracted by the ball-catching net 310, the netting is wax-coated, so that is absorbs artificial light. Even further, the color of the wax-coating or the color of the netting may be selected to match the color of the backboard.

Figure 12:
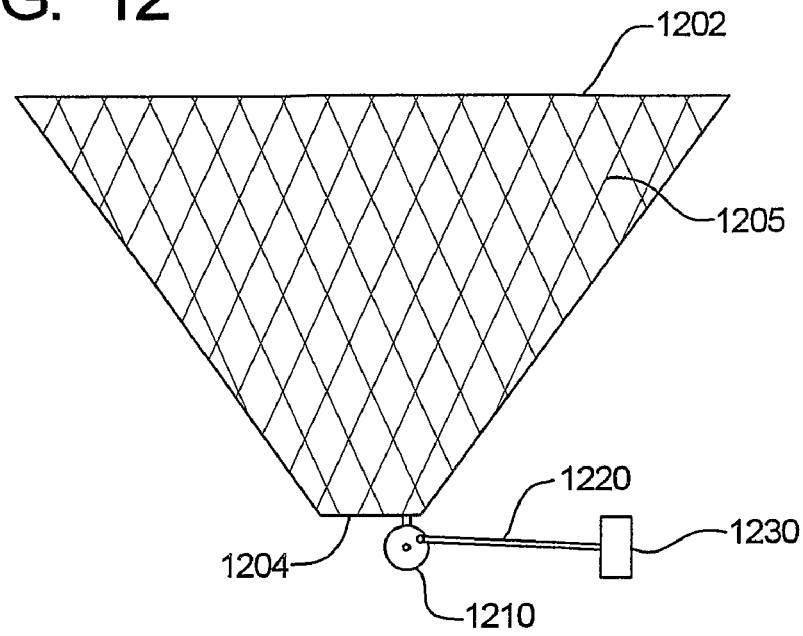
FIG. 12 is a simplified side view of a ball-catching net illustrating a mechanism to cause the bottom of the ball-catching net to vibrate in accordance with one embodiment of the present invention; and, FIG. 13 is a simplified side view of a ball-catching net illustrating shot attempt laser beams in accordance with one embodiment of the present invention.

As shown in FIG. 12, in one embodiment, the ball-catching net 310 includes an upper support member 1202 and a lower support member 1204. In this embodiment, the netting 1205 of the ball-catching net 310 is attached to the upper support member 1202 and the lower support member 1204. In another embodiment, a bungee cord is used to attach the netting 1205 of the ball-catching net 310 to either or both of the upper support member 1202 and the lower support member 1204.

In one embodiment, shown in FIG. 12, ball-catching net 310 includes a mechanism to cause the lower support member 1204 to vibrate, so that balls do not get jammed. For example, the vibrating net can include an eccentric cam having a round plate 1210 with a shaft 1220 that is connected to a motor 1230.

Although the ball-catching net 310 is shown as having an upper support member 1202 having an arcuate shape, it should be understood that the upper support member 1202 may take a variety of shapes. In one embodiment, the upper support member 1202 of the ball-catching net has a polygonal shape.

Instead of using a single backboard 260 (see FIGS. 2 and 3), some embodiments include a first backboard 562 and a second backboard 564, both of which are made of an ultra-light epoxy (see FIG. 5). Furthermore, to reduce energy transfer between the backboards, the first backboard 562 and the second backboard 564 may have a honeycomb shock absorber 566 interposed therebetween.

Figure 6:
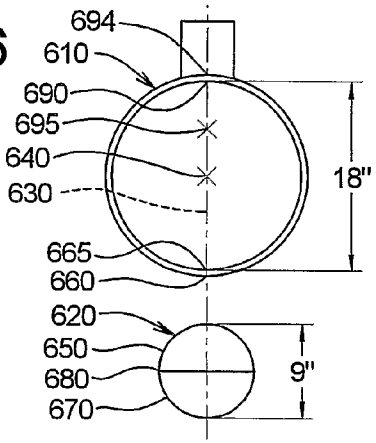
FIG. 6 is a simplified diagrammatic representation of a top view of a standard basketball rim and a standard men's basketball to illustrate features of one embodiment of the present invention.

FIG. 6 is a diagrammatic representation of a top view of a standard basketball rim 610, along with a top view of a standard men's basketball 620. As is well-known, a standard basketball rim has an inner diameter of about 18 inches, while a standard men's basketball has an outer diameter of about 9 inches. Furthermore, a standard basketball rim also has a thickness of 1 inch.

The inventor has observed that, when a shot is thrown towards a rim, assuming the shot is (approximately) in-line with the rim (that is, if an imaginary line 630 was drawn from the back of the rim to the front of the rim and through the center 640 of the rim, half of the ball would be on one side of the line 630 and half of the ball would be on the other side of the line 630), there are seven general categories of shots that are possible.

First, a shot can be thrown short. That is, either the shot will not hit the rim at all or only the front hemisphere of the ball 650 (i.e., a portion of the front 4½ inches of the ball) will hit the outside 660 of the front of the rim. A short shot is incapable of passing through the rim.

Second, a shot can be thrown such that the ball's rear hemisphere 670 (i.e., a portion of the rear 4½ inches of the ball) will hit the inside 665 of the front of the rim. Such a shot is capable of passing through the rim.

Third, a shot can be thrown such that the ball's equator 680 hits the top of the front of the rim (i.e., a position between the outside 660 of the front of the rim and the inside 665 of the front of the rim). This type of shot is capable of passing through the rim.

Fourth, a shot can be thrown such that the entirety of the ball 620 passes through the rim without contacting the rim. This is known a "swish" shot, due to the sound made by the net (not shown in FIG. 6).

Fifth, a shot can be thrown such that the ball's front hemisphere 650 hits the inside 690 of the back of the rim. Such a shot is capable of passing through the rim.

Sixth, a shot can be thrown such that the ball's front hemisphere 620 hits the outside 694 of the back of the rim 690. Such a shot is capable of passing through the rim. For example, because of its backspin, the ball may be drawn down into the hoop.

Seventh, and finally, a shot can be thrown such that the ball's equator 680 hits the top of the back of the rim (i.e., a position between the inside 690 of the back of the rim and the outside 694 of the back of the rim). Such a shot is capable of passing through the rim, for example, by contacting the backboard (not shown in FIG. 6). It should be noted that, due to the backboard, only about a one and one-half inch area (one inch thickness of the rim and ½ inch portion of the flange) can be struck by the ball's equator 680.

With the above-described categories of shots in mind (and not including shots that are specifically directed at the backboard, i.e., "bank" shots) and keeping in mind that basketball players generally shoot the ball short when under pressure, the inventor has recognized that it is not necessarily of greatest benefit to train basketball players to shoot shots at the center 640 of the rim (although the present invention can be used to train players to shoot at the center 640 of the rim). Instead, the inventor has recognized that it may be more beneficial to train basketball players to shoot shots at a "sweet spot" 695, which is located 4½ inches from the center 640 of the rim (e.g., towards the back 690 of the rim along imaginary line 630 of FIG. 6).

If a basketball player is trained to shoot at the "sweet spot" 695, a shot that hits the "sweet spot" will be a "swish" (or nearly a "swish"). However, if a player shoots a shot "short" due to pressure, for example, the shot still has an opportunity to pass through the rim even when the shot is 13½ inches short of the "sweet spot" 695 (i.e., the center of the basketball is 13½ inches from the "sweet spot" 695).

It should be understood that the invention is not limited to training basketball players to shoot at a "sweet spot" 695 that is 4½ inches from the center 640 of the rim in a direction towards the back 690 of the rim. For example, a player may be trained to shoot at a "sweet spot" which is less than or greater than 4½ inches from the center 640 of the rim in a direction towards the back 690 of the rim. In yet other embodiments, the basketball training system and/or methods of the present invention may train basketball players to shoot at the center 640 of the rim.

For example, when shooting shots from all distances except when shooting free throws, a basketball player may be trained to shoot at a "sweet spot" where the exact center of the ball enters the rim at the exact center of the rim. (For convenience, this location will be referred to as "center sweet spot.") And, when shooting free throws, a basketball player may be trained to shoot at a "sweet spot" which is at a point that is four inches from the exact center of the rim (along a line passing through the center of the rim and perpendicular to the backboard) in a direction towards the backboard. (For convenience, this location will be referred to as "free-throw sweet spot.")

The observations made by the inventor with respect to FIG. 6, along with the teachings associated with FIGS. 1-5, will be used to describe a basketball training system which trains basketball players to shoot at a "sweet spot."

Figure 7:
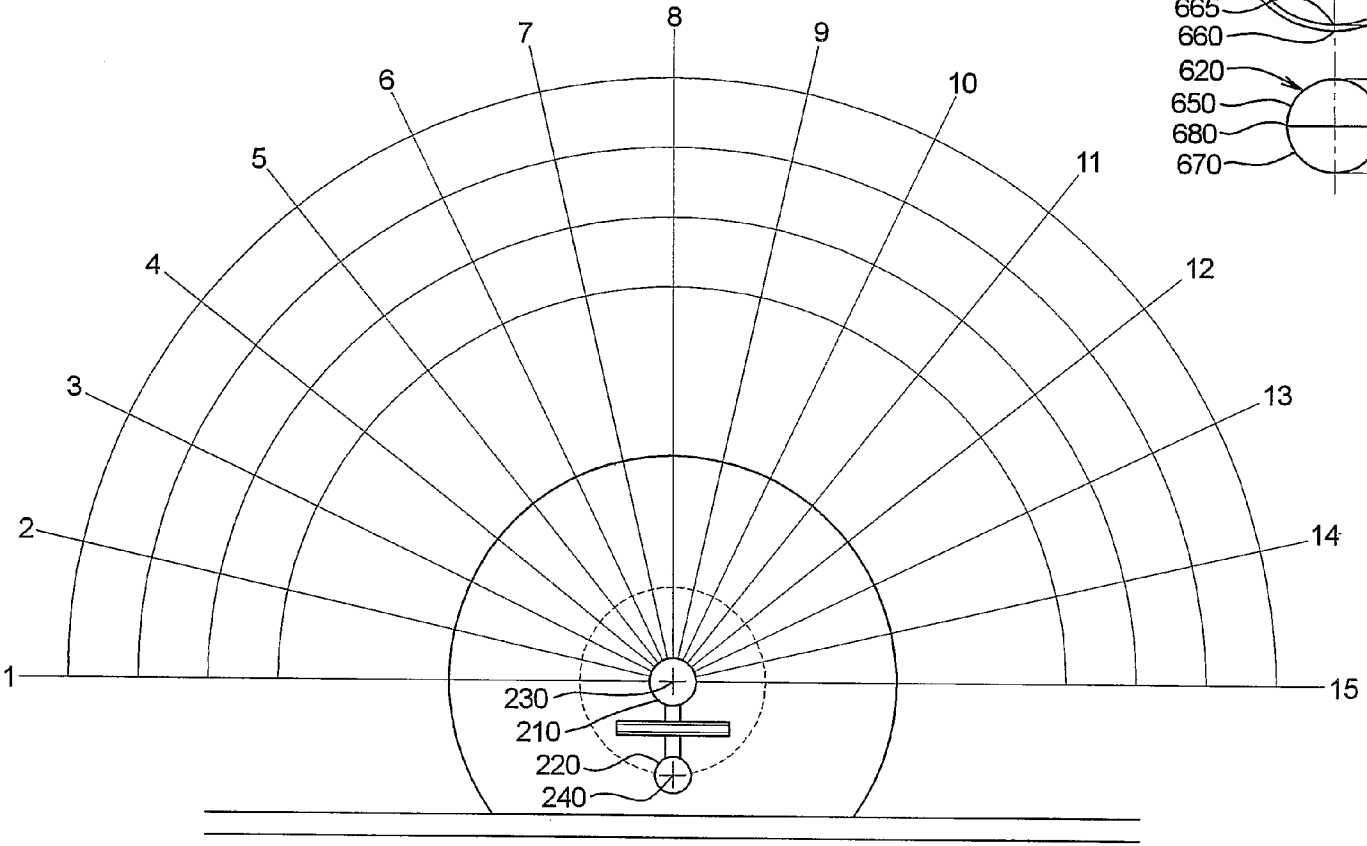
FIG. 7 is a simplified diagrammatic representation of a top view of a dual-rim system (similar to FIG. 5) illustrating first and second rims of different diameters which may be used in accordance with one embodiment of the present invention.

FIG. 7 is a diagrammatic representation of a top view of a basketball training system similar to that shown in FIG. 5. Instead of first rim 210 and second rim 220 being of equal diameter, the first rim 210 and the second rim 220 have different diameters. In one embodiment, the diameter of the second rim 220 may be less than that of a standard rim. For example, the diameter of the second rim 220 may range from 13 inches to just under 18 inches. (In other embodiments, the diameter of the second rim 220 may be 18 inches or larger. For example, when used with small children, the second rim 220 may have a diameter from 19 inches to 22 inches.)

Accordingly, when shooting at a rim having a smaller diameter (with all other things remaining equal), the center of the rim is located at a distance which is moved a little closer to the backboard (when a shooter is shooting a shot in a direction which is perpendicular to the front of the backboard), as compared to the center of the rim for a standard rim. For example, if the diameter was decreased by four inches to 14 inches, the center of the rim will be two inches closer to the backboard, as compared to a standard rim. Accordingly, using a rim having a smaller diameter will train a basketball player to shoot closer to the "sweet spot" of a standard rim by developing a shooter's muscle memory.

There are a variety of other techniques that can be made to train a basketball player to shoot closer to the "sweet spof" of a standard rim. These techniques may be used independently of one another or in combination with one another. For example, in addition to decreasing the diameter of one of the rims, the flange length (see, flanges 270 and 280) may be decreased from a standard length (i.e., five inches) to a smaller length. In one example, by decreasing the flange length by 2½ inches and by decreasing the diameter by 4 inches, the center of the rim will be 4½ inches closer to backboard (when shooting a shot in a direction perpendicular to the front of the backboard), as compared to a standard rim. Accordingly, a basketball player will be trained to shoot to closer to a "sweet spot" of a standard rim.

Other techniques of developing muscle memory to train a basketball player to shoot closer to a "sweet spot" of a standard rim include using a bigger ball and/or a heavier ball. For example, the ball may have a diameter that is ¼ inch to ½ inch larger than a standard basketball and/or the ball may weigh 1-2 ounces more than a standard basketball.

In yet another technique, one of the rims is raised relative to a standard height. This may be accomplished, for example, by providing a motor and a gear that will allow one of the backboards (having a rim at a standard height) to be raised relative to the other backboard (see FIG. 5, which shows two backboards 562, 564), as will be understood by those skilled in the art. Without wishing to be bound by any theory, it is believed that a change in rim height of two inches corresponds to a shooter being trained to shoot to a location that is approximately four inches closer to the backboard relative to the center of the rim (when shooting a shot in a direction perpendicular to the front of the backboard).

Exchanging a standard rim (which should not be confused with interposing the rims, discussed below) for a rim with a diameter smaller than a standard rim (or visa versa) is relatively simple. For example, the rims may be manufactured and exchanged in accordance with U.S. Pat. No. 5,308,059, which is incorporated herein by reference.

In another embodiment, the rims may include telescoping and retracting portions, which allow for the adjustment of rim diameter manually or using a motor, among other things. In this embodiment, the rims might not have a perfectly circular shape (although this will not be readily discernable by the shooter).

Figure 8:
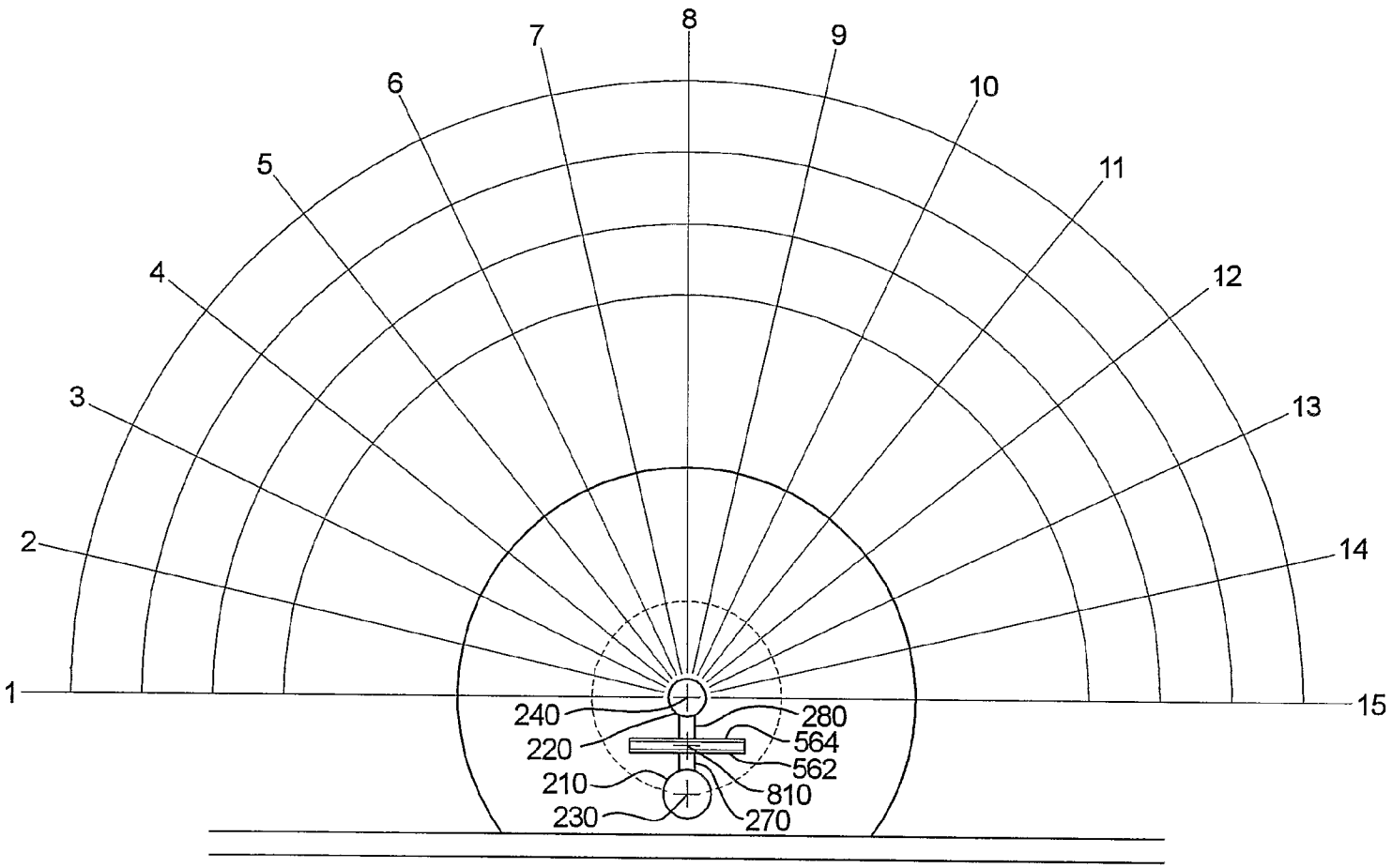
FIG. 8 is a simplified diagrammatic representation of a top view of a dual-rim system (similar to FIG. 7) illustrating a manner of interposing the rims of FIG. 7 in accordance with one embodiment of the present invention.

FIG. 8 is a simplified diagrammatic representation of a top view of another embodiment of a basketball training system. The embodiment shown in FIG. 8 is more easily understood when viewed in conjunction with FIG. 7.

Specifically, the basketball training system of FIG. 8 shows first rim 210 has been interposed with the second rim 220 by providing a pivot point 810. In one embodiment, the pivot point 810 is located a position that is equidistant from the center of first rim 210 and the second rim 220.

For example, in one such embodiment, the pivot point 810 is located halfway between the two backboards 562, 564. In this embodiment, the length of the flange 280 associated with the rim with a small diameter (i.e., the rim 220 in FIG. 8) has a length that is greater than the flange 270 associated with the rim with a standard diameter (i.e., the rim 210 in FIG. 8), so that the distance from the center of the second rim 220 to second backboard 564 is equal to the distance from the center of the first rim 210 to the first backboard 562.

Once the rims have been interposed, the second rim 220 rotates about its center 240, while the center of the first rim 230 revolves about the center 240 of the second rim 220. In one embodiment, players are able to shoot at a standard rim 210 having a standard diameter from a distance relative to the center of the standard rim 210 that is equal to the distance relative to a rim 220 having a diameter smaller than a standard diameter, once the rim 220 has been interposed with the standard rim 210.

Figure 9:
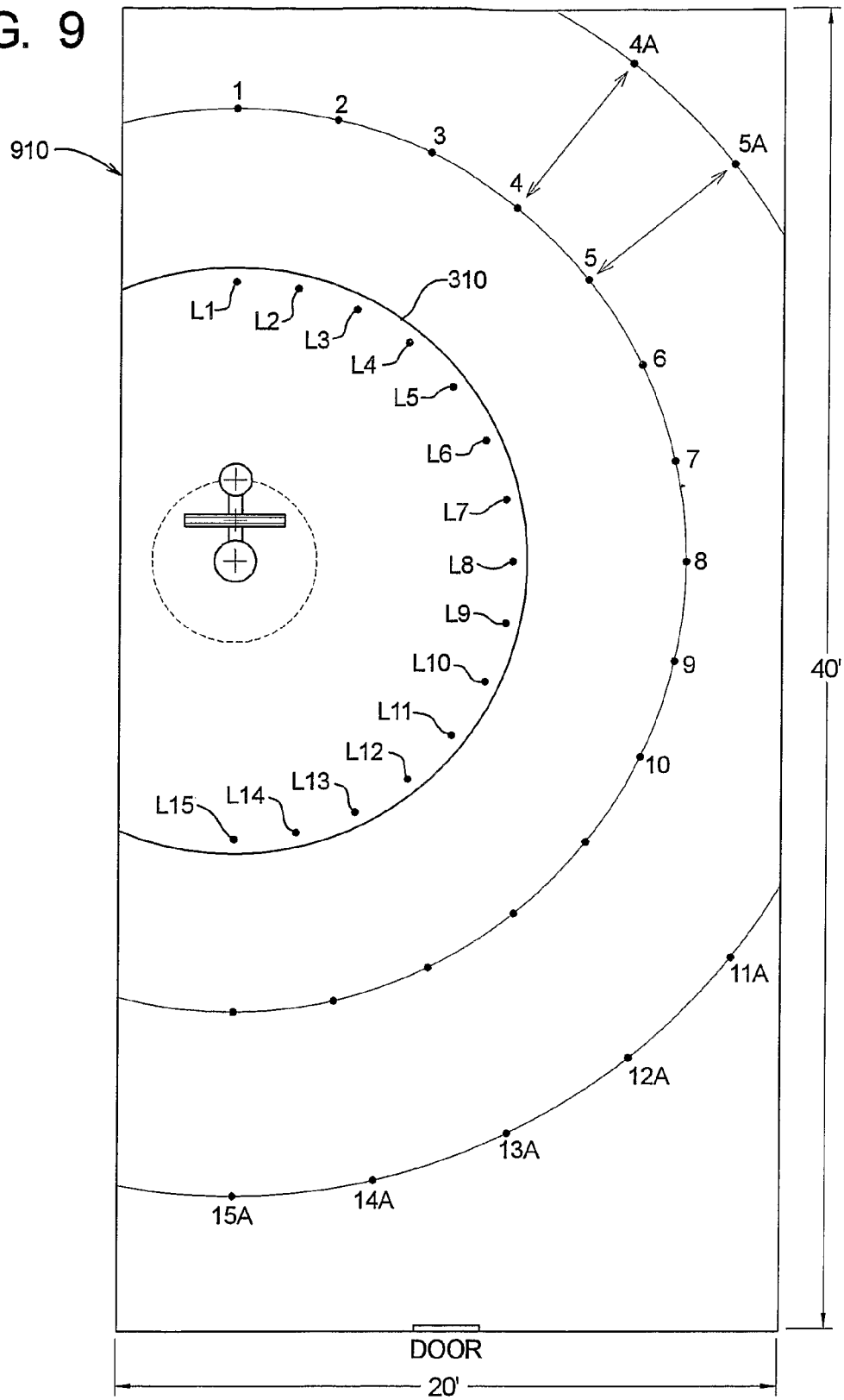
FIG. 9 is a simplified diagrammatic representation of a top view of a dual-rim system that may be used in a standard racquetball court in accordance with one embodiment of the present invention.

FIG. 9 is a simplified diagrammatic representation of a top view of a basketball training system that is designed for use in a racquetball court. Because racquetball was an extremely popular sport in the 1980's and early 1990's, many health clubs that were built during the 1980's and 1990's include racquetball courts. For a variety of reasons, racquetball has lost its popularity. Accordingly, health clubs throughout the U.S. are littered with empty racquetball courts that are occupying valuable real estate.

As shown in FIG. 9, a standard racquetball court is 20 feet by 40 feet. One or more features of the embodiments of the present invention, as described in connection with FIGS. 1-8, may be used in a standard racquetball court.

Specifically, the basketball training system can be placed in a racquetball court to allow at least 8 players to shoot shots at a first rim at a distance that is approximately equal to a free throw (i.e., 15 feet). Furthermore, the basketball training system also allows at least 4 players (note that 7 player locations are shown, i.e., 4A, 5A and 11A-15A) to shoot shots at a first rim at a distance that is approximately equal to an international three point shot (although, if desired, these players may also shoot from closer distances and, in some cases, farther distances).

Figure 10:
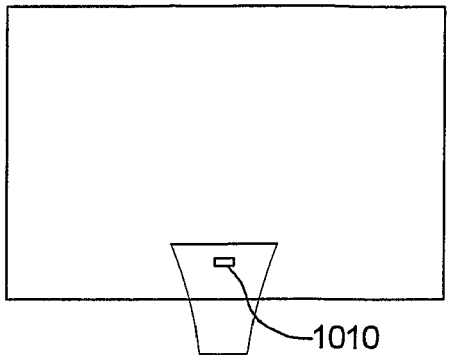
FIG. 10 is a simplified plan view of a laser mounted under a rim and on a backboard, wherein the laser used to count made shots in accordance with one embodiment of the present invention.
Figure 13:
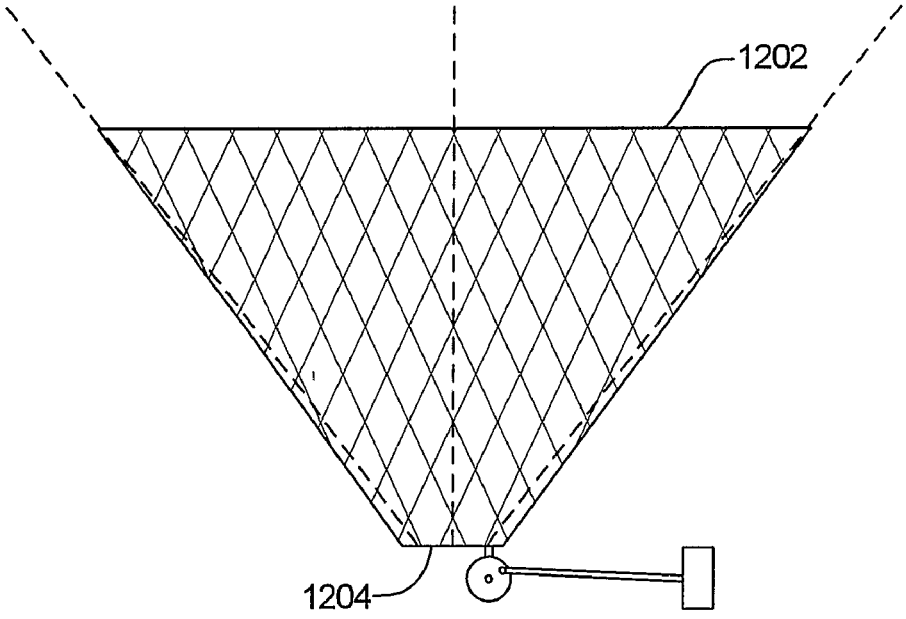

FIGS. 9 and 13 illustrate shot-attempt laser beams L1-L15 (only 3 beams are shown in FIG. 13) emanating from shot-attempt lasers, while FIG. 10 illustrates a shot-made sensor 1010, which are used in conjunction with one another to determine a shooter's shooting accuracy. In one embodiment, the shot-attempt laser beams L1-L15 are positioned along a radial line from the center of the first rim 210 to their corresponding shooting positions, so that the beams pass at a location just inside the upper support member of the ball-catching net. The shot-attempt lasers each direct a beam towards a ceiling at an angle of about 30 degrees relative to the ceiling, such that corresponding beams and corresponding radial lines associated with corresponding player positions lie in a plane that is generally perpendicular to the ceiling. Each beam is received by a beam detector (not shown). When a shot is attempted, it breaks the beam (as detected by the detector) and, thus, an attempted shot is counted.

FIG. 10 includes a shot-made sensor 1010 that is located below the middle of the rim. The shot-made sensor 1010 directs an invisible beam away from the backboard to approximately the center of the rim. If a ball breaks the shot-made sensor's beam within a predetermined time from breaking a shot-attempt laser beam (e.g., 0.2 to 0.5 seconds), a made shot is recorded. If a ball does not break the shot-made sensor's beam within the predetermined time, the shot is counted as a missed shot.

By viewing a record of the number of shots made and missed by a particular player at simulated positions on a basketball court, a coach can determine a player's shooting strengths and shooting weaknesses. A coach can then develop a specific training program to address a player's shooting weaknesses.

Figure 11:
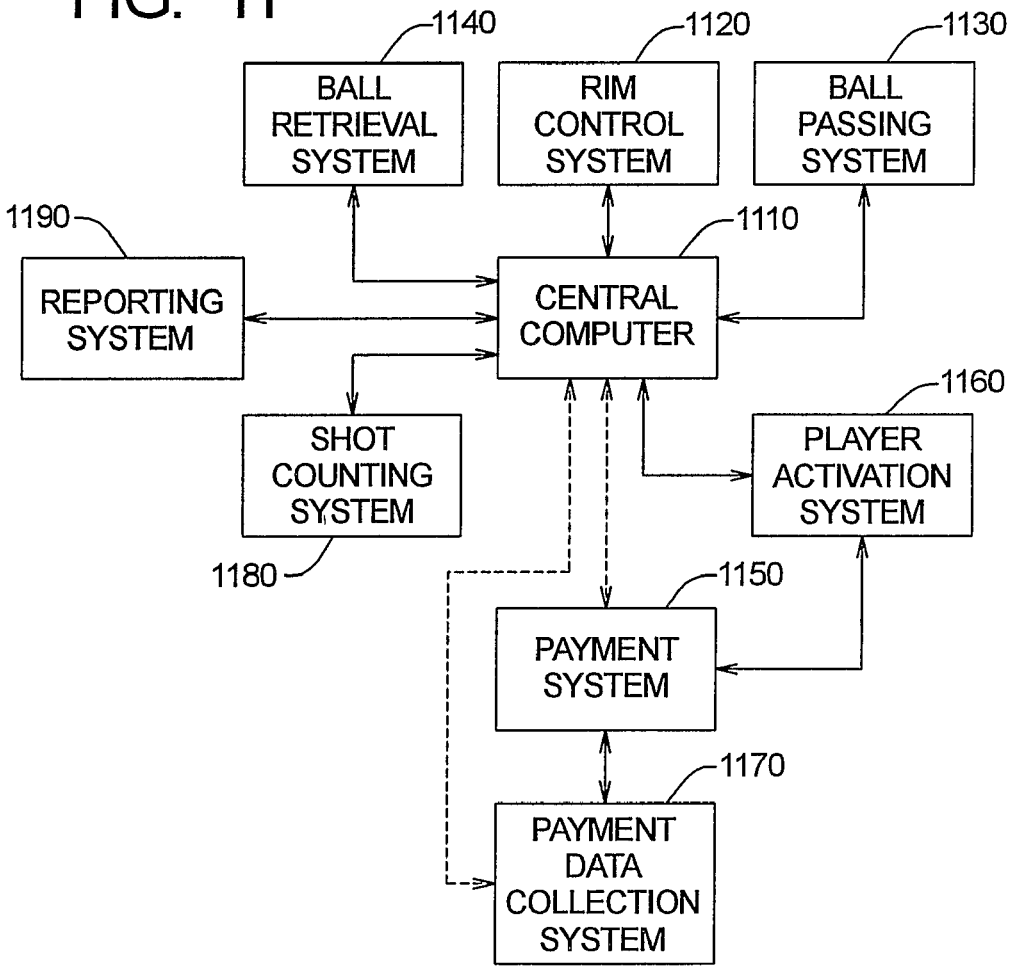
FIG. 11 is a simplified block diagram of a basketball training system that may be used on a pay-per-use basis in accordance with one embodiment of the present invention.

FIG. 11 is a simplified diagrammatic representation of a basketball training system that can be used on a pay-per-use (pre-payment) basis and that has many features controlled by a central computer. As will be understood by those skilled in the art, a central computer 1110 can be used to control many of the features of the embodiments described above.

For example, the central computer 1110 can be used to operate the rim control system 1120 to control the speed and amount of rotation of the rims, along with monitoring the location of the rims, among other things. The central computer 1110 can also be used to operate the ball passing system 1130 to control the passing interval, the passing speeds, the passing locations, the types of passes, the passing length and the passing height, among other things. The central computer 1110 can further be used to operate the ball retrieval system 1140 to control the vibration rate of bottom of the ball-catching net, among other things.

In order to use the basketball training system of FIG. 11 on a pay-per-use basis, a patron approaches an automated payment system 1150 or a desk clerk operating the payment system, who collects payments at a predetermined rate. For example, a patron might be charge 1 penny per shot (e.g., $10 for one hour of continuous shooting when shooting 1 shot every 3.6 seconds).

After receipt of payment, the patron is provided with a player activation system 1160, which may include a remote control associated with a particular shooting position (e.g., one of shooting positions 1-15). Preferably, both a remote payment data collection system 1170 and the central computer 1110 are advised that a payment was made by a patron and that the patron has received a particular player activation system 1160.

When a patron is ready to begin shooting, the patron moves to the shooting position associated with his player activation system 1160 and presses an activation button (e.g., a green "go" button) on the player activation system 1160, which notifies the central computer 1110 that a player will be shooting from the position associated with the player activation system 1160. Accordingly, upon command from the central computer 1110, passes are delivered to such shooting position by the ball passing system 1130. The player activation system 1160 may also include buttons which allow a patron to select one of a plurality of ball-passing speeds, one of a plurality of types of passes, one of a plurality of ball-passing lengths and/or one or more of a plurality of ball-passing heights. In the absence of a patron making a selection, default settings (that are programmed into the central computer or the player activation system) are used. Furthermore, the player activation system 1160 may include a pause button (e.g., a red "stop" button) in case the patron becomes tired or needs to stop the shooting session for some other reason. The central computer 1110 will then by-pass the shooting position associated with the paused player activation system.

The central computer 1110 can be used in conjunction with the shot counting system 1180 to record various data. For example, the central computer 1110 can be used with the shot counting system 1180 to record the number of shots taken, to record the number of shots made, to record the position of the rim when each shot was taken, to record the diameter of the rim when each shot was taken, to record the height of the rim when each shot was taken, to record the rim's flange length when each shot was taken, to record the size of the ball when each shot was taken, to record the weight of the ball when each shot was taken, to record the passing location when each shot was taken, and/or to determine whether the patron has exhausted his pre-paid shots, among other things.

As each shot is taken by a patron, the central computer 1110 can communicate with the payment data collection system 1170, the payment system 1150 and/or the player activation system 1160. This communication can be made using wired or a wireless communication means (either now known or later developed), as will be understood by those skilled in the art.

The central computer 1110 can also operate in conjunction with a reporting system 1190. For example, upon completion of a shooting session, a player (or coach) may receive a print-out summarizing the various system variables and the player's shooting performance. The print-out may be provided as part of the original fee for using the basketball training system or for an additional fee.

When a team has purchased or leased the basketball training system, the payment system 1150 and payment data collection system 1170 are generally not used (at least, not in the manner described in connection with FIG. 11, above). In such situations (or even in other situations), a coach may develop a specific shooting program to address a player's shooting weaknesses. As an alternative, a report regarding a player's shooting proficiency may be provided to outside consultants (i.e., shooting experts), who may analyze the report and may devise a program for the player.

The present invention may include a plurality of motors. For example, motors can be provided for: turning the impeller, rotating the turret, vibrating the bottom of the ball-catching net, interposing the rims, rotating the rims, raising one backboard relative to the other backboard, and raising the entire unit up and down on tracks, among other things.

Although embodiments of the present invention have been described using two rims, it should be understood that more than two rims may be used. In one embodiment, the first rim would rotate about its center, while the center of the other rims would revolve about the center of the first rim.

It should also be noted that the present invention can be designed so that players can shoot from positions located 360 degrees around the machine, instead of 180 degrees as shown in the figures. In one embodiment, the ball passing system includes two ball passers, each of which is responsible for passing balls to player locations over approximately a 180 degree range and two ball-catching nets, each of which is responsible for be-netting balls over approximately a 180 degree range.

As will be understood by those skilled in the art, many of the embodiments described above can be used in combination with one another. The present disclosure is intended to cover such combinations.

It should also be understood that this disclosure is intended to cover video games that embody the principles of the present invention.

While an effort has been made to describe some alternatives to the preferred embodiment, other alternatives will readily come to mind to those skilled in the art. Therefore, it should be understood that the invention may be embodied in other specific forms without departing from the spirit or central characteristics thereof. The present examples and embodiments, therefore, are to be considered in all respects as illustrative and not restrictive, and the invention is not intended to be limited to the details given herein.

What is claimed is:

1. A basketball training apparatus comprising:

a first rim having a center;

a second rim having a center, wherein the first rim rotates about its own center while the center of the second rim revolves about the center of the first rim; and, a backboard assembly having first and second opposing sides, wherein the first rim is connected to the first side of the backboard assembly and the second rim is connected to the second side of the backboard assembly.

2. The apparatus of claim 1, wherein the first rim has a first diameter and the second rim has a second diameter, and wherein the first diameter is different from the second diameter.

3. The apparatus of claim 1, wherein the first rim is at a first height and the second rim is at a second height, wherein the second height is greater than the first height.

4. The apparatus of claim 3, wherein the backboard assembly includes a first backboard and a second backboard, and wherein the first rim is connected to the first backboard and the second rim is connected to the second backboard.

5. The apparatus of claim 4, further including a gear associated with the first and second backboards, which is used to elevate or lower the second rim relative to the first rim.

6. The apparatus of claim 1, wherein the first rim has a flange having a first length and the second rim has a flange having a second length.

7. The apparatus of claim 6, wherein the first length is different from the second length.

8. The apparatus of claim 1, wherein the first rim and the second rim may be interposed by pivoting about an axis that does not correspond with the center of the first rim or the center of the second rim.

9. The apparatus of claim 1, wherein the second rim rotates about its center and the first rim revolves about the center of the second rim after the first rim and the second rim have been interposed.

10. The apparatus of claim 1, wherein the backboard assembly is a single backboard.

11. A basketball training method comprising the steps of:

providing a first rim having a center;

providing a second rim having a center;

providing a backboard assembly having first and second opposing sides, wherein the first rim is connected to the first side of the backboard assembly and the second rim is connected to the second side of the backboard assembly; and, rotating the first rim about its own center while the center of the second rim revolves about the center of the first rim.

12. The method of claim 11, wherein the first rim has a first diameter and the second rim has a second diameter, and wherein the first diameter is different from the second diameter.

13. The method of claim 11, wherein the first rim is at a first height and the second rim is at a second height, wherein the second height is greater than the first height.

14. The method of claim 11, further including the step of: elevating the second rim relative to the first rim.

15. The method of claim 11, wherein the first rim has a flange having a first length and the second rim has a flange having a second length.

16. The method of claim 15, wherein the first length is different from the second length.

17. The method of claim 11, including the step of:

interposing the first rim and the second rim by pivoting about an axis that does not correspond with the center of the first rim or the center of the second rim.

18. The method of claim 17, including the step of:

rotating the second rim about its center while the center of the first rim revolves about the center of the second rim.

* * * * *